United States Patent [19]

Mady et al.

[11] Patent Number: 4,762,572

[45] Date of Patent: Aug. 9, 1988

[54] PROCESS FOR PHOSPHATING ELECTROLYTICALLY ZINC-COATED METALS

[75] Inventors: Raschad Mady, Pulheim; Caecillie Daniel, Monheim; Detlev Bohnhorst, Cologne; Karl-Heinz Gottwald, Erftstadt; Roland Morlock, Bergheim, all of Fed. Rep. of Germany

[73] Assignee: Gerhard Collardin GmbH, Cologne, Fed. Rep. of Germany

[21] Appl. No.: 921,665

[22] Filed: Oct. 20, 1986

[30] Foreign Application Priority Data

Oct. 18, 1985 [DE] Fed. Rep. of Germany ..... 3537108

[51] Int. Cl.[4] ..... C23C 22/13; C23C 22/18

[52] U.S. Cl. ..... 148/6.15 Z

[58] Field of Search ..... 148/6.15 Z

[56] References Cited

U.S. PATENT DOCUMENTS

| | | | |
|---|---|---|---|
| 3,338,755 | 8/1967 | Jenkins | 148/6.15 Z |
| 3,625,777 | 12/1971 | Okabe et al. | 148/6.15 Z |
| 3,810,792 | 5/1974 | Ries et al. | 148/6.15 Z |
| 4,497,668 | 2/1985 | Mady et al. | 148/6.15 Z |
| 4,595,424 | 6/1986 | Hacias | 148/6.15 Z |

FOREIGN PATENT DOCUMENTS

| | | | |
|---|---|---|---|
| 0060716 | 9/1982 | European Pat. Off. . | |
| 0135622 | 4/1985 | European Pat. Off. . | |
| 2038105 | 7/1970 | Fed. Rep. of Germany . | |
| 2043085 | 8/1970 | Fed. Rep. of Germany . | |
| 2931693 | 12/1980 | Fed. Rep. of Germany | 148/6.15 Z |
| 2072225 | 9/1981 | United Kingdom | 148/6.15 Z |
| 2093075 | 8/1982 | United Kingdom | 148/6.15 Z |
| 2106146 | 4/1983 | United Kingdom | 148/6.15 Z |

OTHER PUBLICATIONS

Industrie-Lackierbetrieb 1983, Moderne Zinkphosphatierverfahren . . . articles, by Dr. Klaus Wittel, pp. 169–171, 210–215.

SAE Technical Paper Series 820336, The Pretreatment of Steel . . . article by, J. W. Davis.

Second Generation Zinc Phosphate Coatings (May, 1982), pp. 1–3.

Galvanotechnik (1968), article by C. Reis, pp. 37–39.

*Primary Examiner*—Sam Silverberg

*Attorney, Agent, or Firm*—Ernest G. Szoke; Henry E. Millson, Jr.; Mark A. Greenfield

[57] ABSTRACT

A method for phosphate coating zinc or nickel-zinc alloy electrolytically coated metal surfaces, in which they are exposed to a phosphating solution containing zinc, manganese, and phosphate ions, and optionally cobalt and/or nitrate ions. The method is conducted at an elevated temperature for up to slightly more than 5 seconds.

29 Claims, No Drawings

PROCESS FOR PHOSPHATING ELECTROLYTICALLY ZINC-COATED METALS

BAGKGROUND OF THE INVENTION

1. Field of the Invention

This invention relates to an improved process for the production of finely crystalline, uninterrupted conversion coatings, predominantly consisting of zinc phosphate, with a low weight per unit area. The coating is produced in very short treatment times on electrolytically zinc-coated metals, particularly ferrous metals, for example on electrolytically zinccoated steel strip.

The process according to the invention is not confined to pure zinc coatings and may also be used for treating steel strip which has been coated with a zinc alloy. In addition to zinc, the alloy may contain iron, nickel and cobalt.

2. Statement of Related Art

The use of zinc-coated steel, especially electrolyically zinc-coated steel in strip form, has become very important in recent years. As a result, considerable work has been done on pretreatment or phosphating processes for electrolytically zinc-coated strip steel.

Weights per unit area of from 2 to 3 g/m$^2$ were regarded as necessary to achieve adequate protection against corrosion both in the subsequently lacquered state and in the initial (phosphated) state. These comparatively heavy coatings produced a number of problems, including unsatisfactory adhesion properties of subsequent coatings, particularly where further processing involves forming work. Moreover, weights per unit area of more than 2 g/m$^2$ are a disadvantage so far as forming and welding are concerned, even where the steel strip is processed in the unlacquered (i.e., only phosphated) state.

Prior art treatment times were over 5 seconds. Accordingly, desirable strip processing speeds of, for example, from 90 to 120 m/minute were either impossible to achieve or could only be achieved with difficulty and with losses of quality in the form of interrupted coatings.

To produce thin, firmly adhering, corrosion-resistant zinc phosphate coatings on, for example, electrolytically zinc-coated steel surfaces, U.S. Pat. No. 3,625,777 (and corresponding published German application No. 19 55 002) propose using acidic phosphating solutions to which a carbohydrate obtained from starch, a starch derivative or a polysaccharide by acidic decomposition is added. Zinc phosphate coatings having weights per unit area of from 1.2 to 1.8 g/m$^2$ are disclosed as formed in treatment times of from 3 to 10 seconds.

However, the additive mentioned gives rise to difficulties in practice. The organic constituents are decomposed in acidic solutions at elevated temperature and with increasing age of the bath. The initially low weights per unit area of the phosphate coatings undergo a distinct increase. The decomposition products pollute the surrounding atmosphere with their odor. The thick sludge formed is also undesirable.

To form thin uninterrupted phosphate coatings having weights per unit area of less than 1.0 g/m$^2$, U.S. Pat. No. 3,810,792 (and corresponding published German application No. 21 00 021) propose treating the metal surfaces with phosphating solutions essentially containing nickel ions as the layer-forming cations. In addition to the nickel ions, other metal ions, particularly zinc ions, may be present. The mol ratio of the nickel ions to the other divalent metal ions is disclosed as 1:0.001–0.7.

The coatings deposited consist essentially of nickel phosphate. In contrast to the desired zinc phosphate coatings, nickel coatings always necessitate subsequent coating with a lacquer in order to obtain acceptable protection against corrosion. This is a serious disadvantage.

As already mentioned, the need for improved corrosion prevention in many industrial products has led to the increasing use of electrolytically zinc-coated steel. However, this meant that improved phosphating processes were also necessary. The process proposed in commonly assigned U.S. Pat. No. 4,497,668 (and corresponding published German application No. 32 45 411) represents a major step in the desired direction. U.S. Pat. No. 4,497,668 describes a process for phosphating electrolytically zinc-coated steel strip. Zinc phosphate coatings having weights per unit area under 2 g/m$^2$ and preferably from 0.6 to 1.9 g/m$^2$ are deposited in treatment times of not much longer than 5 seconds, and generally in 2.5 to 5 seconds. The disclosed coatings do not have any of the disadvantages caused by heavy coatings without, at the same time, losing any of the required corrosion prevention both in the unlacquered state and in the lacquered state. The phosphating solutions used are acidic phosphating solutions which, in addition to zinc and phosphate ions, may contain other metal cations and/or anions of oxygen-containing acids having an accelerating effect. The content of $Zn^{2+}$-cations is 1–2.5 g/l, the free acid content is 0.8–3 points, and the acid ratio (total acid/free acid) is 5 to 10. Nitrate-containing phosphating solutions are preferebly used.

The ratio by weight of $Zn^{2+}$ to $NO_3^-$ is 1:1–8, while the ratio by weight of $PO_4^{3-}$ to $NO_3^-$ is 1:0.1–2.5.

In addition to zinc, small quantities of nickel may be used, in a weight ratio zinc:nickel of 2–20:1. In general, nickel cannot be analytically detected in the deposited coating, i.e., it is only present in the coating in traces which remain below the detection limit. Phosphating takes place at a temperature of 50° to 70° C. and preferably at a temperature of 60° to 65° C. The process is suitable both for spray coating and for dip coating.

As already mentioned, the use of electrolytically zinc-coated steel in the production of various industrial goods has increased considerably in recent years, for example in the automotive industry. The reason, as already mentioned, is the need for improved corrosion prevention. For the same reason, the automotive industry has changed from anodic electrodeposition to cathodic electrodeposition for the application of primer, particularly to bodies. This demands phosphating processes characterized by a high percentage of iron in the deposited coating , that is, high percentages of zinc iron phosphate (phosphophyllite) should be formed in addition to zinc phosphate (hopeite). The iron required has to be supplied by the substrate through an acidic pickling reaction.

In addition, before cathodic electrodeposition, it has been found to be extremely desirable to deposit phosphate coatings having a cube-like or block-like structure, acicular crystals being undesirable. Both properties, i.e., the iron content of the coating and the altered morphology of the coating, may be obtained by suitable formulation of the phosphating solutions and by appropriate process management. These interrelated factors are discussed in the literature, cf.

1. Klaus Wittel, "Moderne Zinkphosphatierverfahren, Niedrig-Zinc-Verfahren", Industrie-Lackierbetrieb 5/83, page 169 and Industrie-Lackierbetrieb 6/83, page 210.

2. James W. Davis, "The Pretreatment of Steel and Galvanized Steel for Cathodic Electrodeposition Paint Systems", SAE Technical Paper Series 820336, SAE The Engineering Resource for Advancing Mobility, 400 Commonwealth Drive, Warrendale, Pa. 15096, USA.

3. Harry E. Chandler, "Second Generation Zinc Phosphate Coating", Metal Progress May 1982, 1982 American Society for Metals.

The first requirement, i.e., the incorporation of iron in the coating, cannot be satisfied on a zinc surface, as is known in the art. In addition to many other applications, electrolytically zinc-coated strip steel is also used to a large extent in bodywork. In many cases, the phosphate coating is applied in combined zinc-coating and pretreatment lines from which it is passed on as zinc-coated "prephosphated" steel.

The phosphate coating should also be suitable for subsequent cathodic electrodeposition. Since, in the present case iron cannot be incorporated in the phosphate coating, layers having a cube-like or block-like structure have to be produced.

DESCRIPTION OF THE INVENTION

Other than in the operating examples, or where otherwise indicated, all numbers expressing quantities of ingredients or reaction conditions used herein are to be understood as modified in all instances by the term "about".

This invention affords a method for phosphating electrolytically zinc-coated metal workpieces, partucularly zinc-coated steel, especially in the form of stripping.

The phosphating solutions used in this invention are acidic phosphating solutions which, in addition to zinc, manganese and phosphate ions, may contain other metal cations and/or anions of oxygen-containing acids having an accelerating effect. The phosphate coatings produced have weights per unit area of less than 2 g/m$^2$, preferably 0.6–1.9 g/m$^2$, most preferably 0.9–1.6 g/m$^2$.

The acidic phosphating solutions have a zinc cation content of 0.1–0.8 g/l, preferably 0.25–0.6 g/l. The content of manganese (II) cations is 0.5–2 g/l, preferably 0.75–1.25 g/l. The free acid content is in the range 4–8 points, preferably 5–7 points. The acid ratio (total acid to free acid) is in the range 2.5–5 points, preferably 2.8–4.5 points.

Definitions of free acid, total acid, and of the phosphates mentioned hereinafter in phosphating baths can be found in the prior art literature, cf. in particular the article by Christian Ries entitled "Uberwachung von Phosphatierungsbadern (Monitoring of Phosphating Baths)" Galvanotechnik, 50, (1968) No. 1, pages 37 to 39 (Eugen G. Leuze Verlag, Saulgau (Wurtt.)). The points or number of points of the free acid is defined as the number of milliliters of 0.1N NaOH required for the titration of 10 ml bath solution against dimethyl yellow, methyl orange or bromphenol blue. The number of points for total acid is the number of milliliters of 0.1N NaOH required for the titration of 10 ml of bath solution against phenolphthalein as indicator until the first pink coloration appears.

The process according to the invention is further characterized in that the phosphating baths contain nitrate. The ratio by weight of the sum of $Zn^{2+}$ and $Mn^{2+}$ cations to the nitrate ($NO_3^-$) ions is 1:0.5–1.5, preferably 1:0.7–1.25. The ratio of $Zn^{2+}$ to $Mn^{2+}$ is 1:1–3, preferably 1:1.5–2.5. The ratio by weight of $H_2PO_4^-$ to $NO_3^-$ is 6–9:1, preferably 7–8:1. In addition, the ratio by weight of the sum of $Zn^{2+}$ and $Mn^{2-}$ cations to primary $H_2PO_4$- anions must be 1:6–9.

Optionally, it also has proven to be of advantage to run the phosphating solutions according to the invention with a small cobalt cation ($Co^{2+}$) content. The cobalt content, based on the combined content of $Zn^{2+}$ and $Mn^{2+}$, is 1 part by weight of $Co^{2+}$ to 100–150 combined parts of $Zn^{2+}$ and $Mn^{2+}$.

The treatment times are deliberately kept short to accomodate modern plants for the electrolytic zinc coating and phosphating of steel strip, which utilize strip speeds of 90 to 120 m/minute. The treatment time is minimally that which is long enough to produce the desired coating, up to slightly more than 5 seconds, preferably 2.5–5 seconds, more preferably 3–4 seconds.

Phosphating is best carried out at elevated temperature, more especially at a temperature of 40°–70° C., preferably 45°–55° C. Any technically practicable possibility of applying the treatment solution may be used. It is of particular advantage that the process according to the invention is suitable for spray coating, dip coating, and combinations thereof.

Before the phosphating solution is applied, the electrolytically zinc-coated surface has to be made completely wettable with water. This facility is generally present in strip plants. If the surface of the electrolytically zinc-coated strip is oiled for temporary corrosion prevention, this oil has to be removed before phosphating using known suitable preparations and processes.

Before phosphating, the water-wettable electrolytically zinc-coated metal surface is best treated with known activating solutions. The activating solutions essentially contain titanium salts and phosphates together with organic components. References to suitable acitivation solutions and processes can be found in published German patent applications Nos. 20 38 105 and 20 43 085.

According to published German patent application No. 21 00 021, it can also be of advantage for the process according to the invention to passivate the conversion coatings deposited with dilute chromic acid and/or phosphoric acid. The chromic acid concentration is generally from 0.01 to 1 g/l. The protective coatings may also be passivated with dilute chromic acid containing chromium (III) ions. The concentrations generally used are from 0.2 to 4.0 g/l $CrO_3$ (hexavalent chromium) and from 0.5 to 7.5 g/l $Cr_2O_3$ (trivalent chromium).

Phosphate coatings clearly showing a cube-like or block-like structure are produced on electrolytically zinc-coated steel from the acidic phosphating solutions according to the present invention. This structure is shown by photomicrographs taken with a scanning electron microscope. It was not possible to obtain such a structure with previously known processes, including the process described in published German patent application No. 32 45 411, which gives acicular crystals. Accordingly, the process according to the present invention solves the problem of producing a conversion coating suitable for subsequent cathodic electrodeposition on electrolytically zinc-coated metal, especially steel. The described coating is also obtained on a steel electrolytically coated with a zinc-nickel alloy.

Compared with conventional processes, the conversion coating obtained is lighter in color. This is particularly desirable when the electrolytically zinc-coated and phosphated steel is used without any further coating. In that case, phosphating is expected considerably to delay or suppress the appearance of "white rust" (formation of zinc corrosion products) as well as "red rust" (iron corrosion products).

The coatings deposited from the acidic phosphating solutions according to the invention satisfy this requirement far better than coatings deposited from conventional treatment baths.

This can be demonstrated by comparative testing in accordance with DIN (German Industrial Norm) No. 50 021 (salt spray test).

In recent years, water storage tests have been carried out to an increasing extent for the combined adhesion and corrosion testing of electrolytically zinc-coated, phosphated steel lacquered using a cathodic electrodeposition paint as primer. In these tests, too, the coatings deposited from the acidic phosphating baths according to the invention proved to be superior to the coatings produced by conventonal processes.

By virtue of their high free acid content, the acidic phosphating baths according to the invention produce very little sludge. This is a considerable advantage in terms of practical application.

The comparatively low temperatures of 45° to 55° C. at which the bath may be operated meet energy-saving requirements.

As mentioned at the beginning, the deposited coatings consist predominantly of zinc phosphate. By virtue of the small quantities of cobalt in the phosphating baths, cobalt cannot be detected in the coatings in the low weights per unit area in which they are deposited in accordance with the invention because the cobalt content is below the detection limit. However, it is surprising that manganese is found in only very small quantities in the coatings deposited from the acidic phosphating solutions according to the invention.

The values found in random samples are from 25 to 125 mg/m$^2$ manganese. The exact mechanism by which coatings are formed from the solution according to the invention is not yet fully understood. However, it may be assumed that the zinc content of the solution is only necessary for the start. With increasing age of of the bath, the zinc required for formation of the coating is supplied by the pickling effect of the acidic phosphating solutions on the electrolytic zinc coating. This view is supported by the results of extensive throughput tests in which the baths were operated without difficulty using "low zinc" to zinc-free replenishing solutions. Thus, a zinc content of 1.0 or higher in the starting bath is not necessary. Furthermore, the inventive method therefore also includes starting the coating using the disclosed $Zn^{2+}$ containing solution and, after it has run long enough to liberate more $Zn^{2+}$ from the metal surfaces being treated, replenishing only the solution ingredients other than $Zn^{2+}$ or only adding sufficient $Zn^{2+}$ to keep the zinc ion content within the range 0.1–0.8 g/l.

The process according to the invention is illustrated by the following Examples:

EXAMPLE I

An electrolytically zinc-coated surface was treated at 30° C. with a solution containing a titanium-containing activating agent of the type described in published German patent application No. 20 38 105 in a quantity of 3 g/l. The activated surface was then treated at 50° C. with a solution having the following composition:

1.1 g/l $Mn^{2+}$
0.50 g/l $Zn^{2+}$
0.01 g/l $Co^{2+}$
11.2 g/l $H_2PO_4^-$
1.5 g/l $NO_3^-$.

The points for free acid were 6 and for total acid 19.6. After a phosphating time of 3.5 seconds, the metal sheet was rinsed with water, passivated with a solution containing $Cr^{6+}+Cr^{3+}$ and dried. The weight of the phosphate coating per unit area was 1.15 g/m$^2$.

After 55 hour salt spray testing (DIN 50021), the unlacquered phosphated sample showed white rust on only 10 to 20% of its surface and no red rust.

EVALUATION TEST

A similarly treated sheet was lacquered by cathodic electrodeposition and provided with a filler and surface lacquer of the type commonly used in the automotive industry. The lacquered surface was bombarded with steel granulate under defined conditions and then stored in a 5% sodium chloride solution for 40 h at 40° C. The sheet was then rebombarded with steel granulate. The area over which the lacquer is destroyed by these tests, i.e., the extent to which the substrate is exposed, can be expressed by a characteristic value:

largest possible area = poorest test result = characteristic value 10 smallest possible area = best test result = characteristic value 1

The metal sheet of Example 1 received a characteristic value of 3 to 4.

EXAMPLE 2

Electrolytically zinc-coated metal sheets were activated, phosphated and then passivated in the same way as in Example 1. The phosphating time and the temperatures were also the same as in Example 1. The same quantities in g/l as in Example 1 were used, but on this occasion the solution did not contain any cobalt. Free acid and total acid were also as in Example 1. The weight of the phosphated coating per unit area was 1.3 g/m$^2$.

After 55 hour salt spray testing, the phosphated unlacquered sample showed white rust over approximately 40% of its surface and red rust over approximately 10% of its surface. The water storage test of the sheet lacquered and evaluation tested in the same way as in Example 1, produced a characteristic value of 6.

Test sheets produced by conventional processes, for example by the process according to published German patent application No. 32 45 411, show distinctly poorer behavior in the described tests.

We claim:

1. A method for phosphate coating an electrolytically zinc or zinc-alloy coated metal surface to a weight per unit area of less than 2 g/m$^2$, comprising exposing said surface to an acid phosphating solution for a time minimally long enough to produce an effective phosphate coating to maximally slightly more than 5 seconds, at a temperature above ambient atmosphere, said phosphating solution comprising essentially of:

(A) zinc cations ($Zn^{2+}$) present in about 0.1–0.8 g/l, (B) manganese cations ($Mn^{2+}$) present in about 0.5–2.0 g/l, (C) phosphate anions ($H_2PO_4^-$), (D) nitrate anions ($NO_3^-$) present in a weight ratio ($Zn^{2+}+Mn^{2+}$):$NO_3^-$ of about 1:0.5–1.5, and (E) cobalt cations ($Co^{2+}$) optionally present in a weight ratio $Co^{2+}$:($Zn^{2+}+Mn^{2+}$) of about 1:100–150;

wherein said phosphating solution has a free acid content of about 4–8 points and a total acid:free acid ratio of about 2.5–5.0.

2. The method of claim 1 wherein the time of said exposing is 2.5 to 5 seconds.

3. The method of claim 1 wherein said cobalt cations are present.

4. The method of claim 1 wherein the time of said exposing is 3 to 4 seconds.

5. The method of claim 1 wherein said zinc cations are present in about 0.25–0.6 g/l.

6. The method of claim 1 wherein said manganese cations are present in about 0.75–1.25 g/l.

7. The method of claim 1 wherein said nitrate anions are present in a weight ratio ($Zn^{2+}+Mn^{2+}$):$NO_3^-$ of about 1:07–1.25.

8. The method of claim 1 wherein the weight ratio $H_2PO_4^-$:$NO_3^-$ is about 6–9:1.

9. The method of claim 1 wherein the weight ratio $H_2PO_4^-$:$NO_3^-$ is about 7–8:1.

10. The method of claim 1 wherein the weight ratio ($Zn^{2+}+Mn^{2+}$):$H_2PO_4^-$ (primary) is 1:6–9.

11. The method of claim 1 wherein the weight ratio $Zn^{2+}$:$MN^{2+}$ is about 1:1–3.

12. The method of claim 1 wherein the weight ratio $Zn^{2+}$:$Mn^{2+}$ is about 1:1.5–2.5.

13. The method of claim 1 wherein said phosphating solution consists essentially of:

(A) zinc cations ($Zn^{2+}$) present in about 0.1–0.8 g/l;

(B) manganese cations ($Mn^{2+}$) present in about 0.5–2.0 g/l;

(C) phosphate anions ($H_2PO_4^-$) present in a weight ratio ($Zn^{2+}+Mn^{2+}$):$H_2PO_4^-$ (primary) of about 1:6–9; and (D) nitrate anions ($NO_3^-$) present in a weight ratio $H_2PO_4^-$:$NO_3^-$ of about 6–9:1.

14. The method of claim 13 wherein said phosphating solution further consists essentially of:

(E) cobalt cations ($Co^{2+}$) present in a weight ratio $Co^{2+}$:($Zn^{2+}+Mn^{2+}$) of about 1:100–150.

15. The method of claim 1 wherein said free acid content is about 5–7 points and said acid ratio is about 2.8–4.5.

16. The method of claim 13 wherein said free acid content is about 5–7 points and said acid ratio is about 2.8–4.5.

17. The method of claim 14 wherein said free acid content is about 5–7 points and said acid ratio is about 2.8–4.5.

18. The method of claim 1 conducted at a temperature of about 40°–70° C.

19. The method of claim 13 conducted at a temperature of about 40°–70° C.

20. The method of claim 14 conducted at a temperature of about 40°–70° C.

21. The method of claim 1 conducted at a temperature of about 45°–55° C.

22. The method of claim 13 conducted at a temperature of about 45°–55° C.

23. The method of claim 14 conducted at a temperature of about 45°–55° C.

24. The method of claim 1 wherein said coated metal surface has been pretreated with a titanium-containing activating solution.

25. The method of claim 1 wherein said phosphate coating is on a continuous flow of said metal surface, and wherein said phosphating solution is maintained by replenishing only those electrolytes which fall below the stated amounts.

26. The method of claim 13 wherein said phosphate coating is on a continuous flow of said metal surface, and wherein said phosphating solution is maintained by replenishing only those electrolytes which fall below the stated amounts.

27. The method of claim 14 wherein said phosphate coating is on a continuous flow of said metal surface, and wherein said phosphating solution is maintained by replenishing only those electrolytes which fall below the stated amounts.

28. The method of claim 1 wherein said coating, predominantly comprising zinc phosphate, is deposited in a weight per unit area of about 0.6–1.9 g/m$^2$.

29. The method of claim 1 wherein said coating, predominantly comprising zinc phosphate, is deposited in a weight per unit area of about 0.9–1.6 g/m$^2$.

* * * * *

UNITED STATES PATENT AND TRADEMARK OFFICE

CERTIFICATE OF CORRECTION

PATENT NO. : 4,762,572

DATED : August 9, 1988

INVENTOR(S) : Mady et al

It is certified that error appears in the above-identified patent and that said Letters Patent is hereby corrected as shown below:

On the cover page, under the inventors the second inventor's name is misspelled as "Caecillie Daniel" and should read --Caecilie Daniel--.

Signed and Sealed this

First Day of August, 1989

*Attest:*

DONALD J. QUIGG

*Attesting Officer*

*Commissioner of Patents and Trademarks*